United States Patent [19]

Thrasher

[11] Patent Number: 4,773,114

[45] Date of Patent: Sep. 27, 1988

[54] GOLF BALL WASHING MACHINE

[76] Inventor: Derone Thrasher, 26661 S. MacArthur, Tracy, Calif. 95376

[21] Appl. No.: 115,894

[22] Filed: Nov. 2, 1987

[51] Int. Cl.[4] ..... A63B 47/04

[52] U.S. Cl. ..... 15/21 A; 15/3.13; 15/3.15; 15/3.16; 15/3.2

[58] Field of Search ..... 15/3.13–3.16, 15/3.19–3.21, 21 A, 97 R

[56] References Cited

U.S. PATENT DOCUMENTS 2,691,786 10/1954 Reading ..... 15/3.15
2,725,686 12/1955 Ash ..... 15/3.2
3,038,186 6/1962 Davy ..... 15/21 A
3,083,389 4/1963 Wittek ..... 15/21 A
4,011,619 3/1977 Michalak ..... 15/21 A

*Primary Examiner*—Edward L. Roberts
*Attorney, Agent, or Firm*—Basil B. Travis

[57] ABSTRACT

A golf ball washing machine has been invented where a detachable upper vibrating trough may receive numerous golf balls and dispense them individually into a spiral cage encircling a rotating brush in a lower water tank where the golf balls are entrapped between the brush and cage interior and are scrubbed as they are forced along the interior of the spiral cage to an exit leaving dirt and debris in the tank.

1 Claim, 3 Drawing Sheets

GOLF BALL WASHING MACHINE

BACKGROUND OF THE INVENTION

This invention relates to a machine for washing golf balls. More particularly, this invention relates to a mechanical apparatus designed to wash a large number of golf balls very rapidly by combining a vibrating feed trough with a spiral washing cage which encircles a rotating brush in a water tank, whereby golf balls are automatically fed into the spiral cage and come into contact with the rotating brush which forces the golf balls through the spiral cage as the brush turns and subsequently ejects them in a clean condition leaving the dirt and debris in the tank. These and other advantages will become apparent from the detailed disclosure of the present invention presented hereinafter.

As it perhaps well known, the game of golf today has become one of the most popular sports not only in the United States, but throughout the world. On golf courses and practice driving ranges everywhere, one major problem has been the cleaning of a large number of used golf balls which are kept on hand for either reuse or rental. Needless to say, these golf balls are subjected to a great deal of physical abuse on the golf course and especially on driving ranges where they are used over and over again. It should not be too difficult to envision the dirt and debris often imbeded in the surface of these golf balls after continual use, but also the gashed and torn surfaces of these balls which not only causes an unsightly appearance but also the possibility of affecting the ball's aerodynamics in flight. Heretofore, dirty golf balls were usually scrubbed clean either by hand or by a machine similar to a polisher with rubber buffer pads. The hand cleaning method was unacceptable for a large number of golf balls due to the amount of time required to clean each one. The polishing machine method was alright for golf balls without damaged surfaces, but where there were cuts or slices in the surface the rubber buffing pads tended to dislodge pieces of the golf ball's surface and these small pieces very often jam the internal working parts of the polishing machine causing the necessity to disassemble and clean the polishing machine itself. It had long been felt that golf ball washing machine was needed to clean a large number of golf balls automatically, quickly, inexpensively, and most importantly, without jamming when rocks or small pieces of the ball were dislodged from the ball'ssurface. These objectives among others are achieved by using my new invention herein described.

SUMMARY OF THE INVENTION

A golf ball washing machine has been invented comprising a detachable vibrating trough in which a large number of golf balls may be deposited and by which golf balls are fed one at a time into a lower water tank means comprising a rotating brush encircled by a spiral cage wherein golf balls are forced along the interior of the spiral cage by the brush and are ejected in a clean condition leaving the dirt and debris in the tank.

DESCRIPTION OF THE PREFERRED EMBODIMENTS

Figure 1:
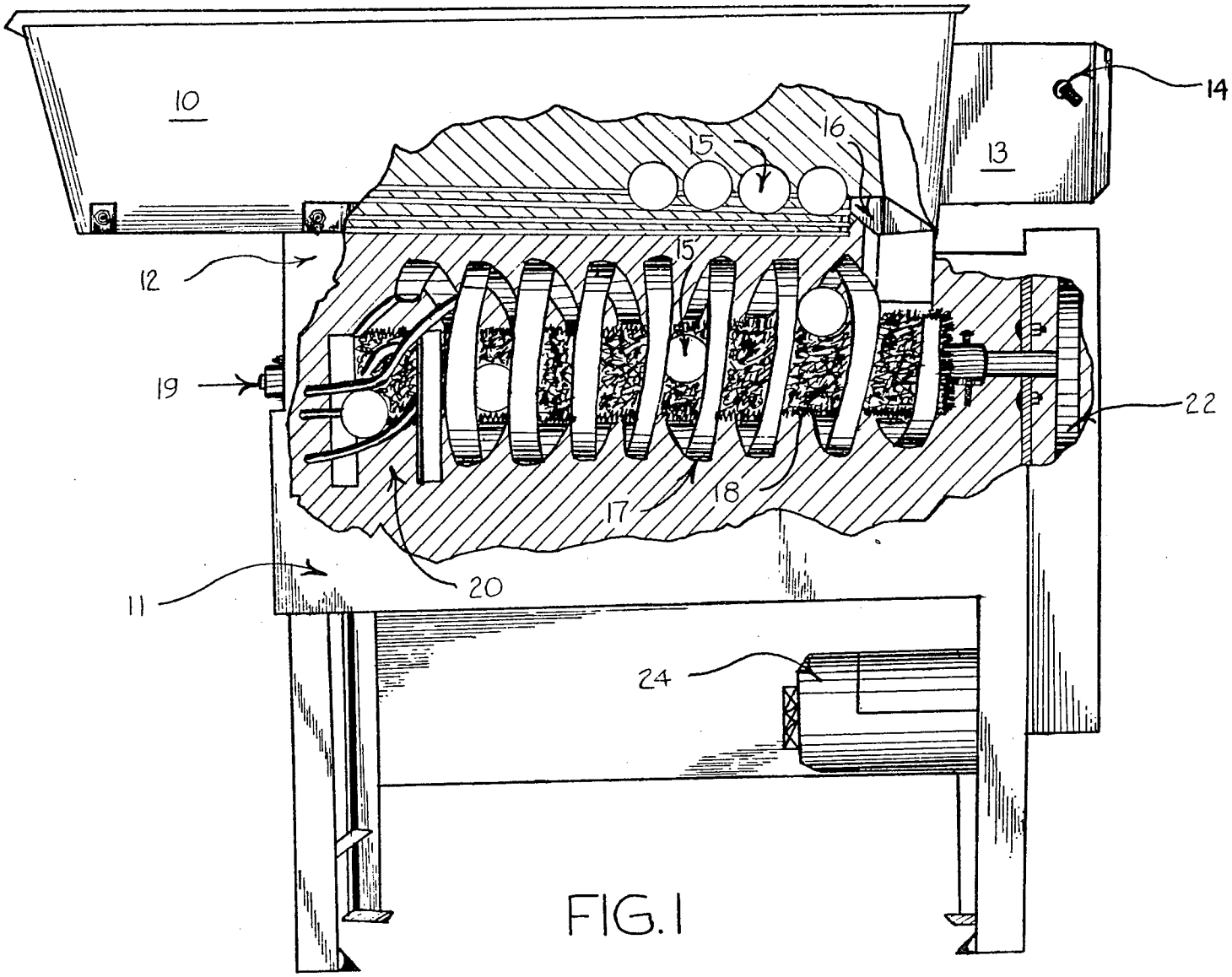
FIG. 1 is a front elevational view of the instant invention, partially cut away.
Figure 2:
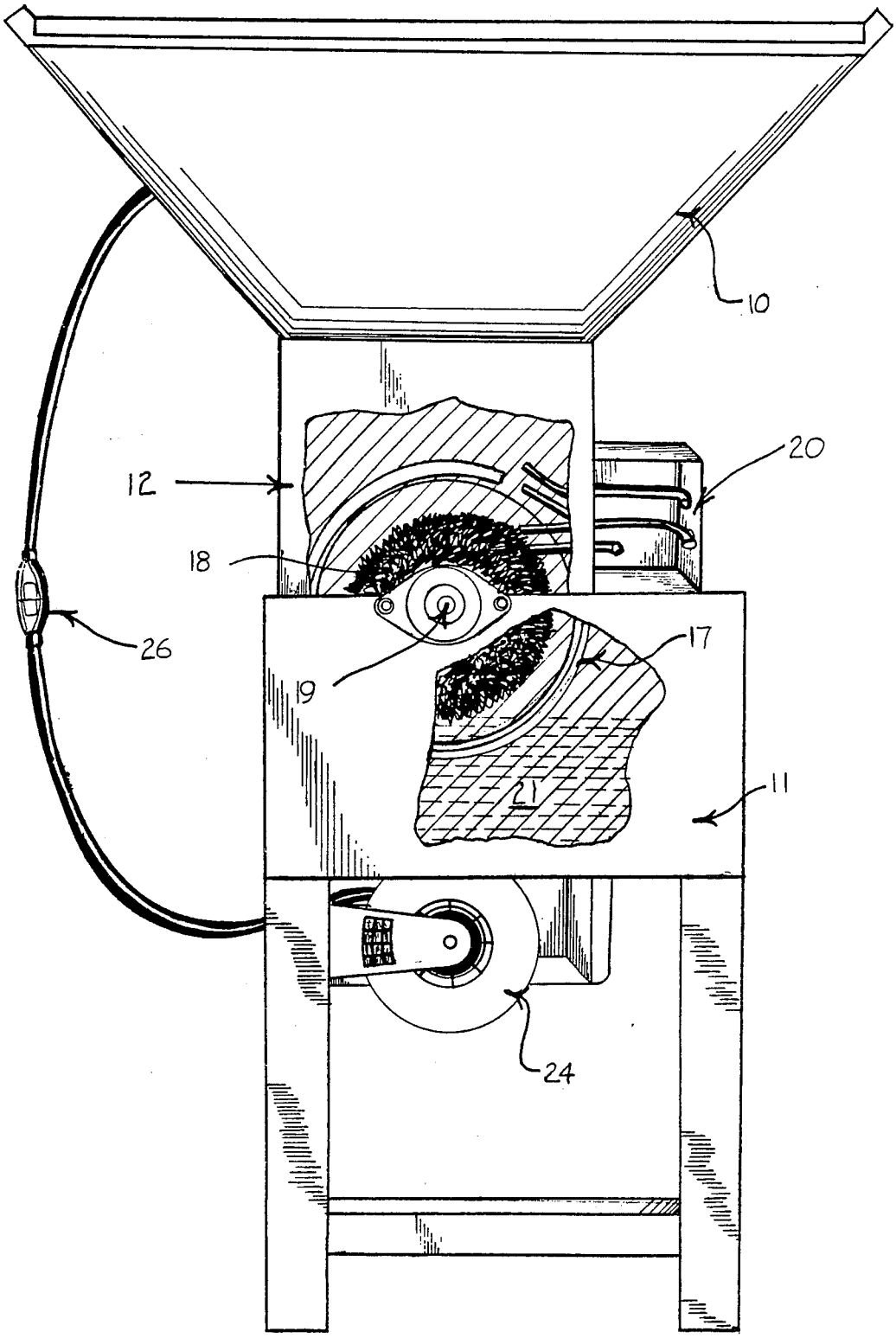
FIG. 2 is a left side elevational view, partially cut away.

Turning now to the drawings, FIG. 1 is a front elevational view of my new golf ball washing machine, partially cut away. A rectangular trough 10 is detachably mounted above the lower tank 11 and is held in place by a plurality of vertical projections 12 engaging and interlocking the tank top in order to form a water tight seal. A vibrator 13, attached to the trough 10, is activated by the main switch 14 to vibrate the numerous golf balls 15 deposited in the trough 10 through its bottom opening 16 and into the spiral cage 17 of the lower tank 11. The spiral cage 17 encircles the length of a circular brush 18 mounted on a rotating shaft 19 which is also activated by the main switch 14. As the golf balls are vibrated into the spiral cage 17, they come into contact with the rotating brush 18 and are forced along the interior length of the spiral cage 17 until they are ejected at the end of the tank by the exit arm rods 20 (FIG. 2). The tank 11 may be filled with water to a level 21 (FIG. 2) where the water is in contact with the rotating brush 18 and by this means the golf balls are washed and scrubbed as they move along the spiral cage 17. The advantage of this system over the prior art is that dirt and debris fall through the spiral cage 17 to the bottom of the tank rather than jamming the internal working parts of the machine.

Figure 3:
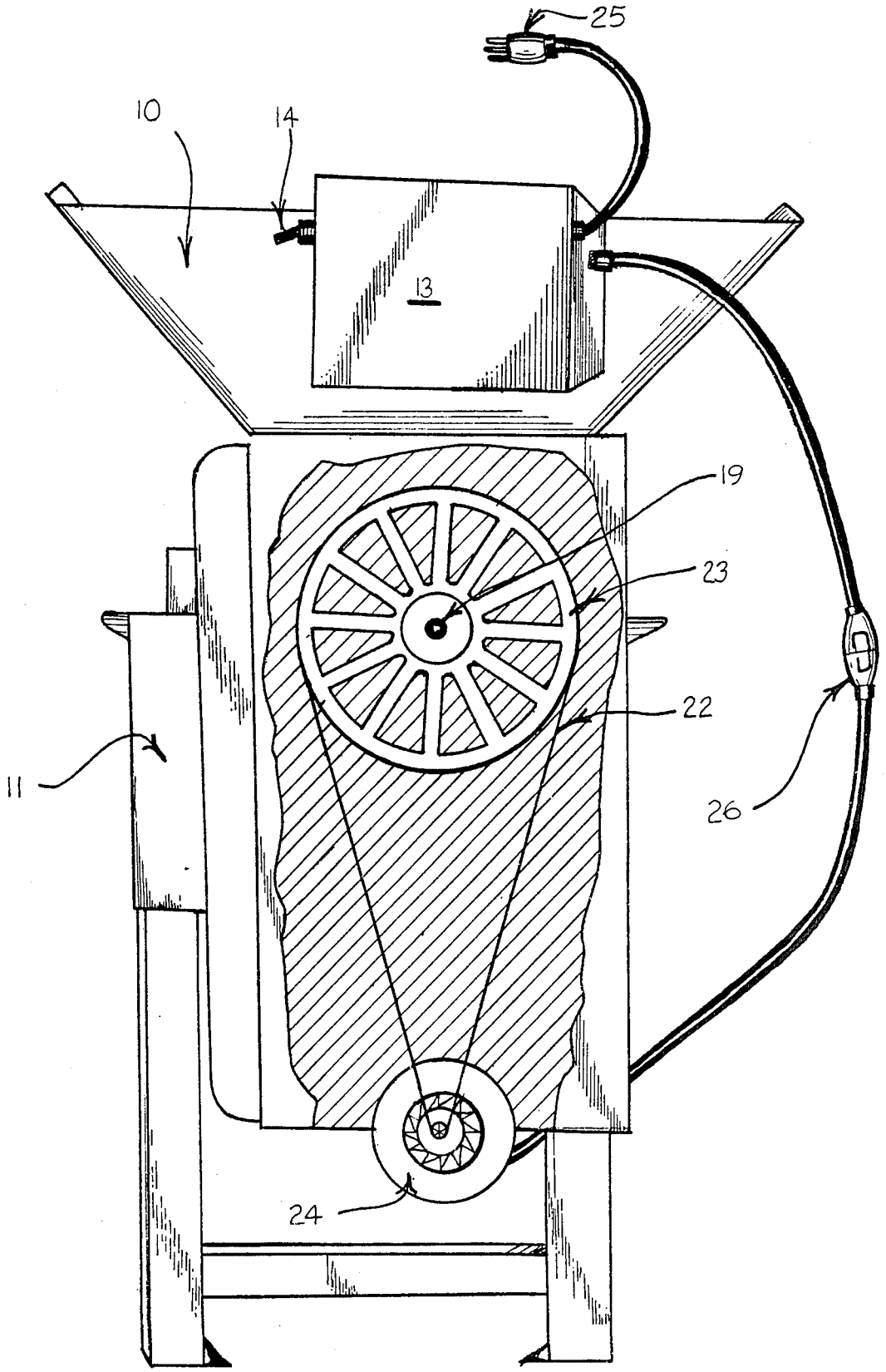
FIG. 3 is a right side elevational view, partially cut away.

Referring to FIG. 3, the shaft 19 is rotated by a pulley 23 and belt 22 system attached to an electric motor 24 which receives normal household current from an electrical plug 25 through the main switch 14 and by way of a detachable cord 26, one-half of which is affixed to the trough 10 and the other one-half is attached to the motor 24 so that, as a safety feature, if the trough 10 should be removed during operation the cord 26 will disconnect and the circuit will be broken thereby stopping the machine.

In practice, to use the machine first make sure that the stopper in the bottom of the tank 11 is in place and fill the tank 11 with water. It is not necessary to add detergent, but any type of liquid or solid detergent may be added at this point. Next, place the detachable trough 10 on the tank 11 by inserting the interlocking vertical projections 12 on the base of the trough 10 into the matching parts of the tank 11 to form a water tight seal. Connect the electrical cords 26 at the rear of the machine together and connect the electrical plug 25 into any standard electrical outlet. Place as many golf balls into the trough 10 as desired and turn on the switch 14. The vibrator 13 will now vibrate the golf balls 15 into the spiral cage 17 of the lower tank 11 through the opening 16 in the trough 10 where the balls are scrubbed by the rotating brush 18 inside the spiral cage 17 and are thereby ejected at the exit arm rods 20.

I claim:

1. A machine for washing golf balls, said machine comprising:

A. a detachable vibratable upper trough means for depositing therein golf balls and dispensing them individually into a lower washing means;

means on said trough to vibrate said trough means;

B. a lower washing means comprising a water tank and further comprising therein a rotating brush encircled by a spiral cage wherein individual golf balls are injected and entraped between the rotating brush and the interior of said spiral cage, and thereby causing the golf balls to be scrubbed as they are forced along the sprial cage to an exit means; means to rotate said brush;

C. an exit means comprising a plurality of rods tangentially positioned to the sprial cage and rotating brush as to receive and eject golf balls from the washing means; and D. a safety disconnect means comprising a detachable electrical cord between said means to vibrate said trough and said means to rotate said brush so that the electrical circuit to said means to rotate said brush will be broken when the trough is removed from the tank.

* * * * *